US005800218A

United States Patent [19]

Abucewicz

[11] Patent Number: 5,800,218

[45] Date of Patent: Sep. 1, 1998

[54] S110 TEST ADAPTER

[75] Inventor: Richard T. Abucewicz, New Britain, Conn.

[73] Assignee: The Siemon Company, Watertown, Conn.

[21] Appl. No.: 921,982

[22] Filed: Aug. 28, 1997

Related U.S. Application Data

[63] Continuation of Ser. No. 334,679, Nov. 4, 1994, abandoned.

[51] Int. Cl.[6] ..... H01R 9/09

[52] U.S. Cl. ..... 439/76.1

[58] Field of Search ..... 439/76.1, 676, 439/638, 289, 700, 655

[56] References Cited

U.S. PATENT DOCUMENTS

| | | | |
|---|---|---|---|
| D. 326,443 | 5/1992 | Ingalsbe . | |
| 3,378,810 | 4/1968 | Dorrell . | |
| 4,431,242 | 2/1984 | Gisewsky . | |
| 4,585,290 | 4/1986 | Knickerbocker et al. . | |
| 4,734,051 | 3/1988 | Burns | 439/289 |
| 4,878,848 | 11/1989 | Ingalsbe . | |
| 4,925,393 | 5/1990 | Ingalsbe . | |
| 4,968,260 | 11/1990 | Ingalsbe . | |
| 5,228,872 | 7/1993 | Liu | 439/76.1 |
| 5,332,397 | 7/1994 | Ingalsbe | 439/76.1 |

OTHER PUBLICATIONS

Systimax PDS Components Guide; Patch Cord Adapters, Dec. 1990.

Independent Technologies, Inc.; 110 Block Adapters.

AT&T Systimax Premised Distribution System; Closures, Cross–Connects & Interconnects; Anixter Bros., Inc. 1992.

Independent Technologies, Inc.; High Quality Quick Connect Adapters.

Independent Technologies, Inc.; High Quality Quick Connect Adapters.

AT&T, Enclosure Letter and Product Card; Feb. 27, 1987; 7 pgs.

Tools and Support Hardware Catalogue; Jun. 1, 1987; 2 pgs.

*Primary Examiner*—P. Austin Bradley
*Assistant Examiner*—Daniel Wittels
*Attorney, Agent, or Firm*—Fishman, Dionne, Cantor & Colburn

[57] ABSTRACT

The present invention provides a unitary, compact telecommunications interface adapter system. The adapter system comprises a bifurcated housing structure enclosing a modular connector and associated category 5 compliant elements. The housing structure has a plug end constructed and arranged for connection to a 110-type telecommunications interface. The associated elements of the adapter are an internal printed circuit board interface between the modular connector and a plurality of longitudinally spring loaded contacts which extend beyond the front perimeter edge of the printed circuit board through channels so that they are exposed for contact outside the housing structure at the plug end. The telecommunications interface adapter system additionally comprises a support structure which has top and bottom spacially parallel extension members integrally formed with the housing structure at the plug end and disposed respectively above and below the longitudinally spring loaded contacts.

10 Claims, 10 Drawing Sheets

S110 TEST ADAPTER

This is a continuation of application Ser. No. 08/334,679 filed on Nov. 4, 1994, now abandoned.

BACKGROUND OF THE INVENTION

This invention relates to electrical connector apparatus and more particularly to telecommunications adapter devices. The device of this invention is particularly useful for electrically connecting a telephone industry 110-type Block or terminal to a modular plug.

The 110 Block Adapter of the present invention provides a means of electrically connecting and adapting a 110 Block to a modular jack for testing new or existing telecommunications wiring installations. The 110 Block Adapter further provides a means of installing new telephone equipment via connection to a 110 Block. The 110 Block Adapter is usable on 110 Blocks for adaptation to a modular jack which receives either 3 or 4 pair modular plugs.

In accordance with present telecommunications industry practice, telephone networks are divided into a telephone company side and a telephone customer side. The division between the two sides of the network is referred to as a demarcation point. It is at this point that the responsibility for installation and maintenance of telephone company and customer equipment is divided. The demarcation point typically comprises a multiple wire, plug-type terminal or interface. An example of such an interface is the 110 Block.

The 110 Block is connected to and terminates the telephone company's line or lines in or at the customer's premises. This typically occurs at either the entrance cable leading into the premises or, for example, in the case of a multiple story building, at the end of a riser cable extending from the entrance cable (located on the ground floor) to an upper floor. The 110 Block provides connections for customer supplied single line or multiple line network equipment depending upon the customer's needs.

The typical 110-type Block or interface comprises a housing structure having multiple longitudinal rows of electrical contacts. The individual rows of electrical contacts may be comprised of several individual clip-on style segments. Each such segment has a plurality, for example 8, of elongated, scissors-type, split or forked electrical contacts arranged side by side in a planar configuration which are uniformly spaced. The contacts are arranged in a thin, relatively flat nonconductive housing which exposes both ends of each contact. At one end of the housing, the contacts are exposed for hook-up with premises interconnect wiring. At the opposite end, the contacts are exposed for contact with an adapter or other customer provided telecommunications equipment. At this end, the housing further includes either an elongated guidepost structure with a tapered end (pair-post) or a shorter guidepost structure with a generally square end (short post) between contacts. Each such structure is cantilevered from the main body of the housing. The pair-posts and short posts form interstitial sockets in which the split contacts are located. The pair-posts and short posts guide the incoming conductors of an external adapter or other telecommunications equipment to the respective sockets for connection with the split contacts. The pair-post structures are disposed between each side-by-side related pair of contacts (each pair of contacts corresponding to one telecommunications line) while the short post structures separate the related pairs. On the top surfaces of both the pair-posts and the short posts are rounded nipples. Only the pair-post bottom surfaces have such nipples. Additionally, the bottoms of the short posts are longitudinally notched; the notches being open to the bottom and also at their outwardly extended end.

The expansion of telephone networks over time, under the current industry practice, has resulted in extensive, complex and variable interface and interconnect wiring installations. This has made cable identification and trouble isolation a more difficult and time consuming task for repair and installation technicians. Thus, there has arisen a need for an apparatus which simplifies the connection of test or other telephone equipment and which utilizes modular connectors comprising male-type plugs and female-type jacks. In the past, connector devices have been used and proposed to adapt demarcation point connections as well as other connections with modular plugs or jacks. However, these devices have proven to be complex, expensive, unreliable, bulky, and difficult to use. And, these devices have generally been unusable with 110-type Blocks.

This has led the industry to seek other devices for adapting a 110 block to a modular jack or other equipment easily and quickly. Efforts expended in connection herewith have produced devices such as U.S. Pat. Nos. 4,878,848 and 4,9968,260 which utilize blade contacts to connect the adapter to the 110 block. A drawback of such blade type connectors is that IDC's in the 110 block can sometimes be at uneven levels or wires connected thereto may be engaged at different levels. The result of the type of situation is that a technician will experience difficulty in achieving a good connection between the adapter and the 110 block. Moreover, prior art devices have failed to meet with category 5 compliancy which is in increasingly ubiquitous demands.

The 110 Block Adapter of the present invention provides an adapter which overcomes the shortcomings, drawbacks and disadvantages of the prior art. The invention provides a compact, durable, and reliable adapter which is simple and easy to use. The 110 Block Adapter of the present invention, is usable on either temporary or permanent telecommunications installations. The device is usable to provide connections to 110 Blocks, and to either 3 or 4 pair modular plugs. It may be used for either troubleshooting or installation purposes. The device also provides a means of establishing temporary cross connects, half-taps for cut over purposes, and conversions to a modular patch panel.

SUMMARY OF THE INVENTION:

The above-discussed and other drawbacks and deficiencies of the prior art are overcome or alleviated by the telecommunications adapter of the present invention.

The device of the present invention provides a unitary and compact telecommunications interface adapter system. The adapter system comprises a modular connection means, such as a modular jack, and a housing structure connected to the modular jack. The housing structure defines a central cavity and a generally rectangular, planar plug end extending from the central cavity for connection to the telecommunications termination to be interfaced with. The adapter further has a plurality of longitudinally spring loaded contacts and means to electrically connect the modular jack and the longitudinally spring loaded contacts. The modular jack and the electrical connection means are enclosed within the central cavity defined by the housing.

Preferably, the housing structure is a bifurcated or two-part structure having a top portion and a bottom portion which are constructed of a nonconductive material in an embodiment where shielding is not contemplated and in a conductive material or nonconductive material treated to provide shielding. The top and bottom portions are coupled via a sonic fusion process, glue, heat welding, etc. The electrical connection means is preferably a printed circuit board communicatively connected to the modular jack and the longitudinally spring loaded contacts. The longitudinally spring loaded contacts are preferably cylindrical and extend horizontally beyond the perimeter of the printed circuit board through channel means so that they are exposed for contact outside the central cavity. The printed circuit board employed includes a plurality of plated through holes sufficient to reduce cross-talk and comply with category 5 criteria. An in depth explanation of the printed circuit board and its relation to category 5 compliancy is found in U.S. Pat. No. 5,295,869, assigned to the assignee hereof and which is incorporated herein by reference.

The telecommunications interface adapter system preferably and additionally comprises means for supporting the adapter system in operative connection to the telecommunications interface. The support means comprises top and bottom spacially parallel extension members integrally formed with the housing structure at the plug end and disposed respectively above and below the longitudinally spring loaded contacts. The parallel extension members additionally include scalloped edges to allow wires terminated in the 110 block to be tested, to pass through the extension without difficulty.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
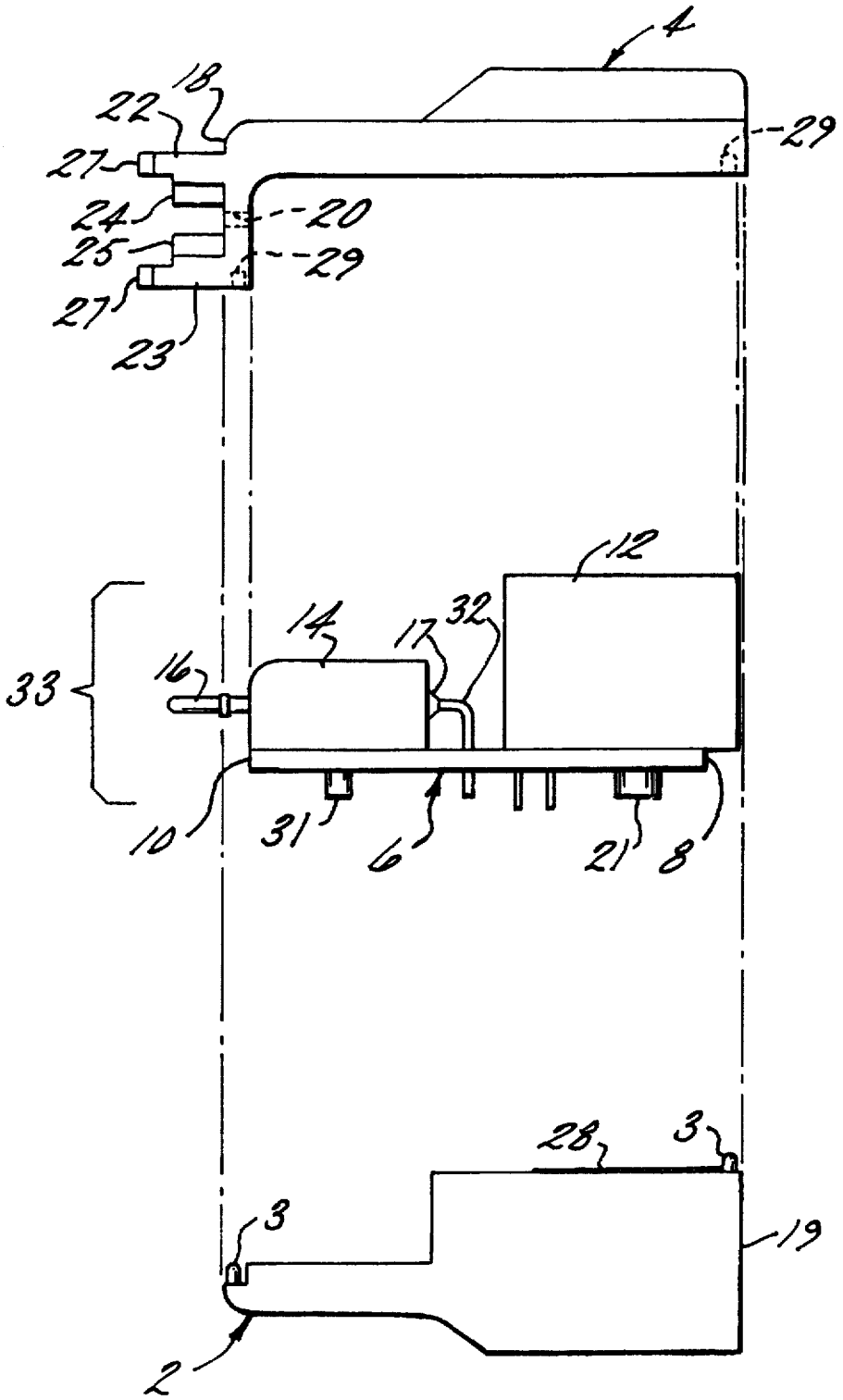
FIG. 1 is an exploded side view of a four pair 110 adapter device of the invention.

The 110 to modular adapter device of the present invention is constructed preferably from a two-piece housing 1, which is comprised of base 2 and cover 4. Base 2 and cover 4 fit together to define an inner cavity suitable for accepting a printed circuit board 6 to which is connected, at a rear edge 8 thereof, a modular jack 12, and at a front edge 10 thereof, a support block 14 for supporting various numbers of spring longitudinally loaded contacts 16. Longitudinally spring loaded contacts 16 preferably pass through a front end 18 of housing 1 to the exterior thereof by means of passages 20. The contacts 16 are resilient in the longitudinal direction, lateral or angular movement being precluded by the support for longitudinal spring loaded contacts 16 provided by support block 14 and passages 20 through front end 18 of housing cover 4. Contacts 16 are protected on an exterior of housing 1 by housing extensions 22 and 23. Modular jack 12 opens through cutout 36, to the rear end 19 of housing 1 for convenient modular plug (not shown) access. Rear end 19 also includes label area 37. It should be noted that in the preferred embodiment housing extensions 22, 23 are part of cover 4 and are shown in the exploded view.

Figure 1A:
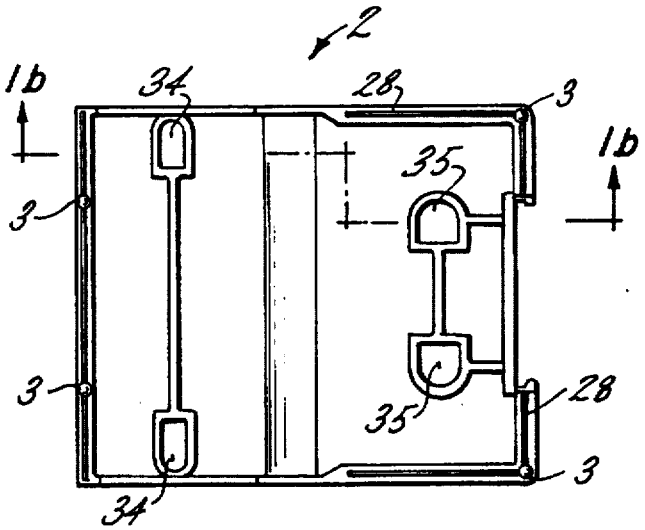
FIG. 1*a* is a plan view of a four pair 110 adapter base.
Figure 4A:
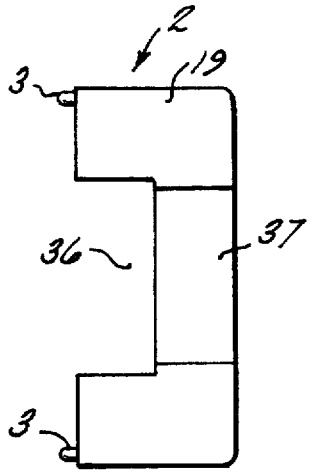
FIG. 4*a* is a rear view of base showing a cutout for modular jack opening.

Referring to FIG. 1*a*, recess 34 provides strain relief from internal components of subassembly 38 by receiving pin 31. Further, strain relief is provided by socket 35. Socket 35 provides such strain relief by engaging jack retention leg 21.

Each housing extension 22 and 23 includes individual structure. Extension 22 includes a plurality of fingers 24 extending from extension 22 in the direction of extension 23 each finger 24 extending into proximity with one of contacts 16. Extension 23 similarly includes fingers 25, however, they extend in the opposite direction of fingers 24 and moreover extend in the same plane on each finger 24. Each finger 24 and 25 together, therefore, form a bridge between extension 23 and 22 broken only by longitudinally spring loaded contacts 16 which extends and moves longitudinally within the plane defined by fingers 24 and 25.

Extension 23 further includes polarity lugs 26 which extend toward extension 22. Polarity lugs 26 ensure that the adapter device can only be placed upon a 110 type block only correctly aligned. Polarity, therefore, will be correct.

A further feature of extensions 22, 23 in the preferred embodiment, is scalloped edges 27 which allow easier use of the adapter by providing a place for terminal wires to go when the adapter is placed in contact with the 110 block. Prior art devices require the wires to bend out of the way, which can create a number of difficulties.

Referring to FIG. 1, housing base 2 includes engagement projection 3 and lip 28 for insertion into cover 4 which includes apertures 29 configured to accept projections 3. Base 2 and cover 4 may then be bonded, glued welded, fused or otherwise affixed around the internal components noted above.

As noted above, interior components include a modular jack 12 operatively connected to a printed circuit board 6, preferably but not necessarily, including plated through holes for category 5 compliance. Printed circuit board 6 further includes a support block 14 mounted thereon which supports anywhere from two to eight longitudinally spring loaded connectors 16, if necessary for some applications. The support block 14 is attached to the board 6 in any conventional fashion, however preferably includes a pin 41 to aid in securing the block to board 6.

Longitudinally spring loaded connectors 16 are inserted into conductive sleeves 17 in support block 14 which in turn are electrically connected via solder tails 32 to printed circuit board 6. It will be appreciated that longitudinally spring loaded connectors 16 are merely pressure retained within sleeves 17 and that they can be easily removed as an integral unit for inspection and/or replacement, if damaged or otherwise desired.

Once internal components are assembled, connectors 16 are inserted into cover 4 through passages 20 until the internal components which form subassembly 33 are fully inserted in cover 4. Thereafter, base 2 is joined.

Figure 1B:
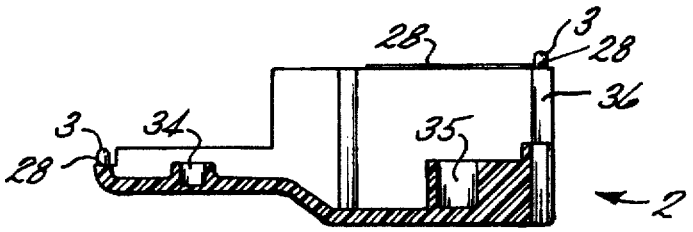
FIG. 1*b* is a cross-section taken along 1*b*–1*b* in FIG. 1*a;*
Figure 2:
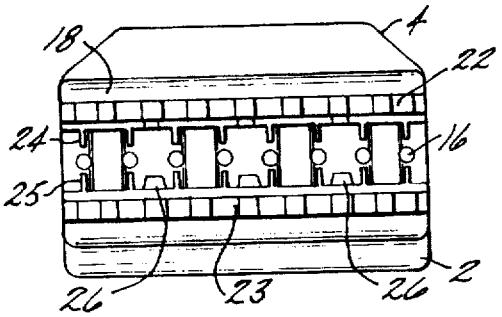
FIG. 2 is a front view of the four pair 110 test adapter of the invention.
Figure 5:
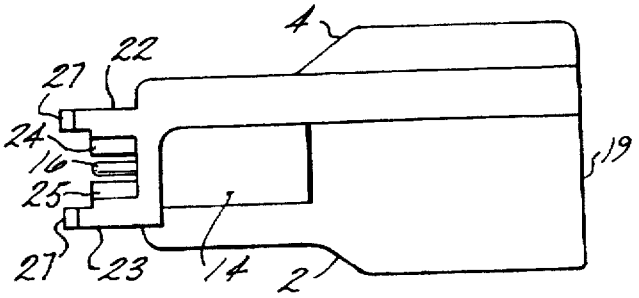
FIG. 5 is a side view of the four pair 110 test adapter of the invention.
Figure 6:
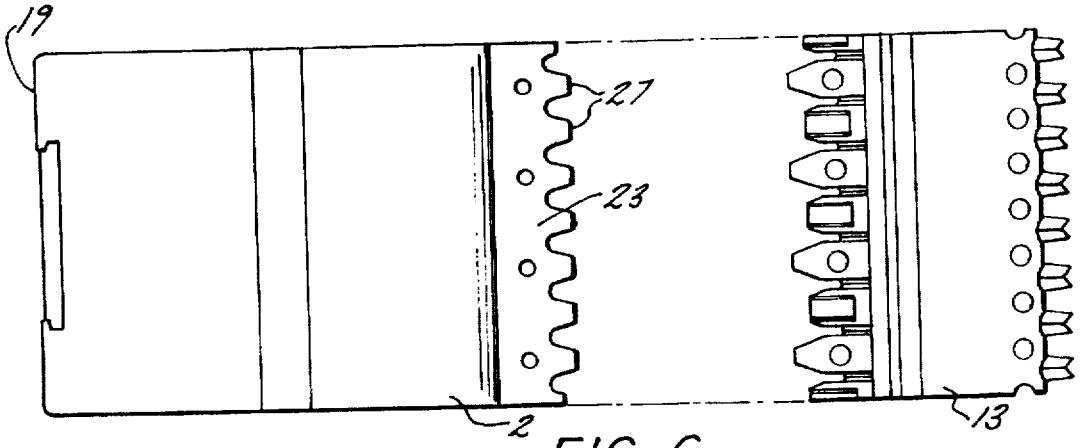
FIG. 6 is a bottom view of the four pair 110 test adapter positioned over a 110 termination block as it will be connected thereto.
Figure 3:
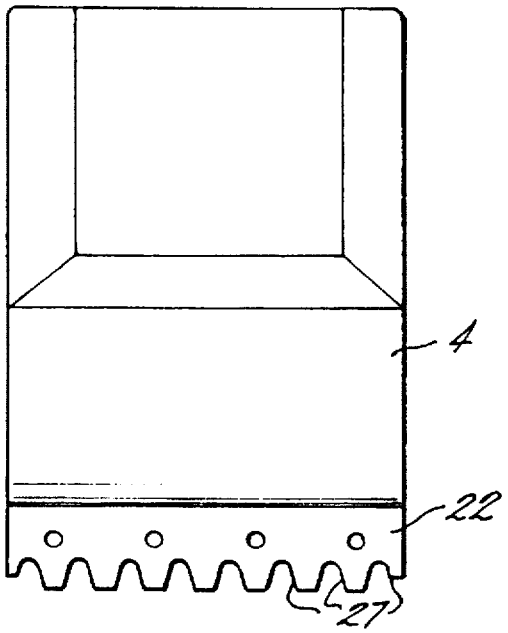
FIG. 3 is a top view of the invention.
Figure 4:
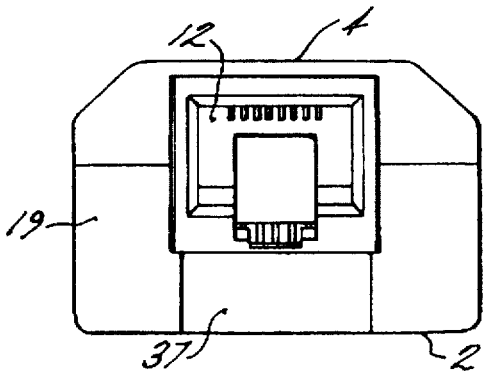
FIG. 4 is a rear view of the invention.
Figure 8:
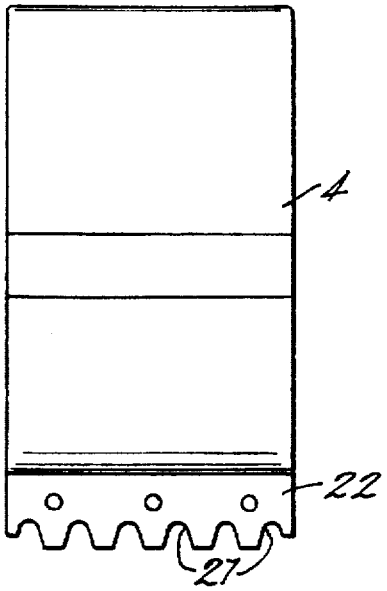
FIG. 8 is a top view of the three pair 110 test adapter.
Figure 9:
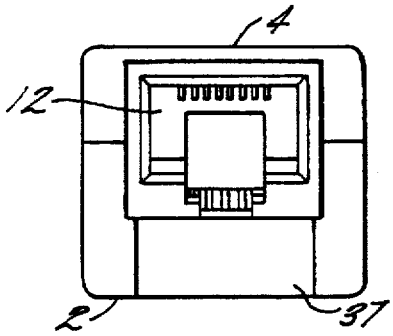
FIG. 9 is a rear view of the three pair 110 test adapter of the invention.
Figure 7:
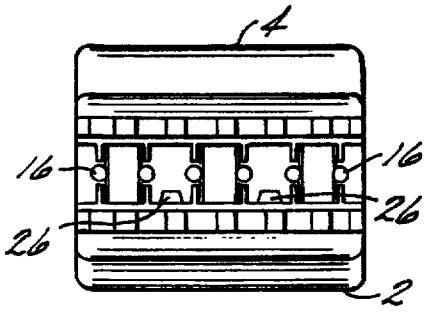
FIG. 7 is a front view of a three pair 110 test adapter of the invention.
Figure 10:
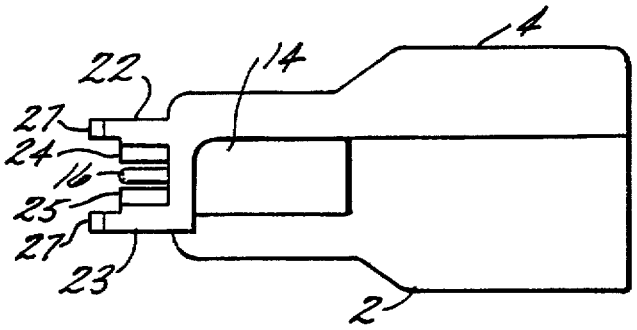
FIG. 10 is a side view of the three pair 110 test adapter of the invention.
Figure 12:
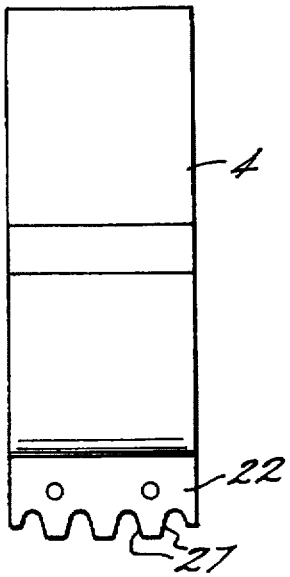
FIG. 12 is a top view of FIG. 11.
Figure 13:
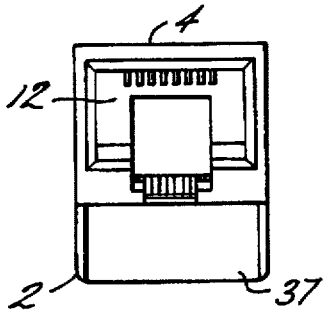
FIG. 13 is a rear view of FIG. 11.
Figure 11:
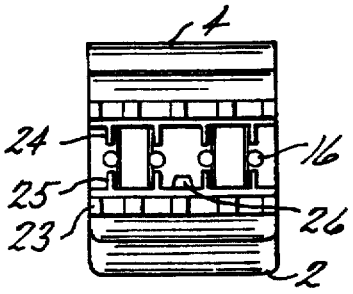
FIG. 11 is a front view of the two pair 1 10 test adapter of the invention.
Figure 14:
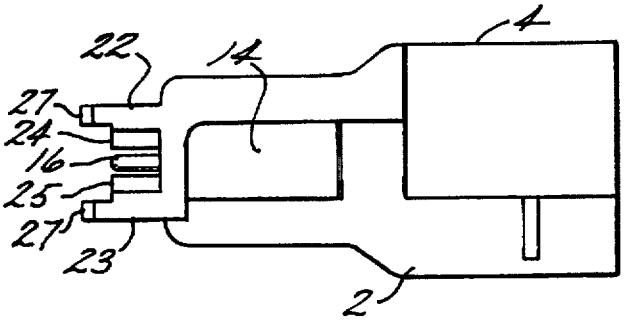
FIG. 14 is a side view of FIG. 11.
Figure 16:
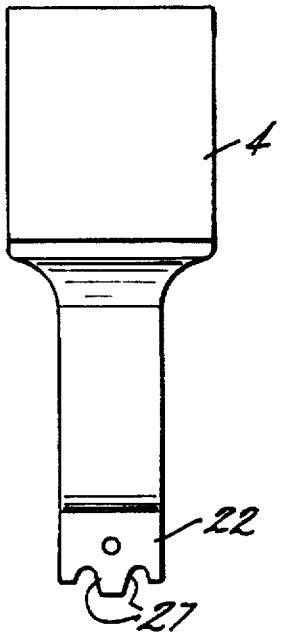
FIG. 16 is a top view of FIG. 15.
Figure 17:
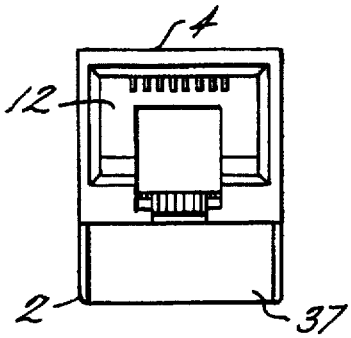
FIG. 17 is a rear view of FIG. 15.
Figure 15:
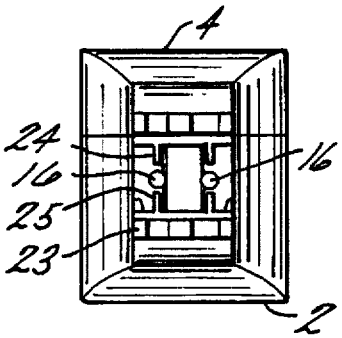
FIG. 15 is a front view of a one pair 110 test adapter of the invention.
Figure 18:
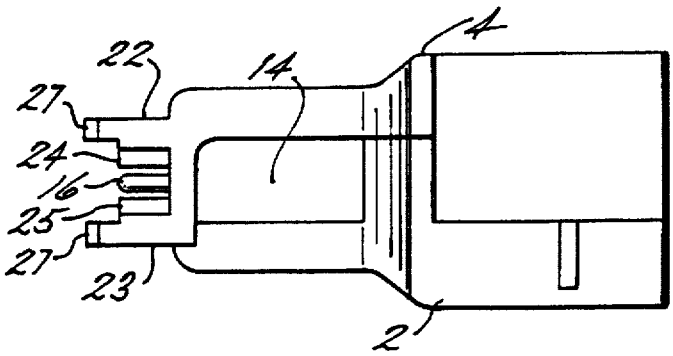
FIG. 18 is a side view of FIG. 15.
Figure 18B:
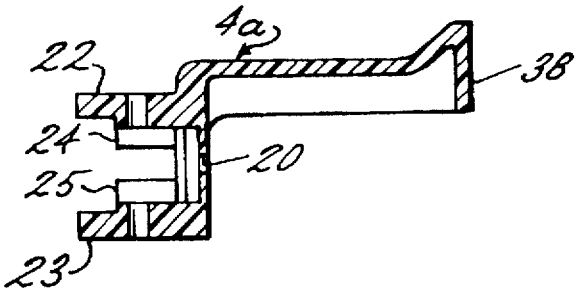
FIG. 18*b* is a cross-section taken along section line 18*b*—18*b* in FIG. 18*a;*
Figure 18A:
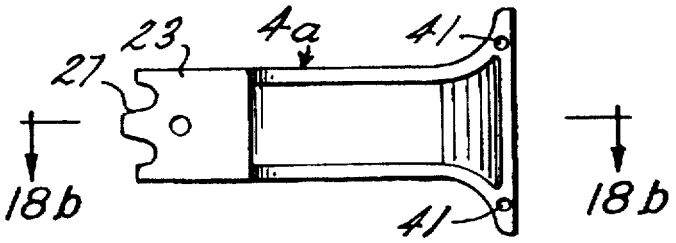
FIG. 18*a* is a bottom view of a one pair cover.
Figure 18C:
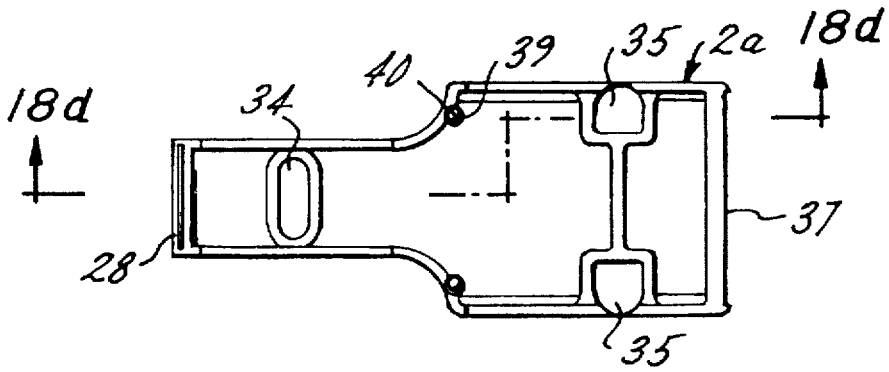
FIG. 18*c* is a plan view of the base of the one pair embodiment.
Figure 18D:
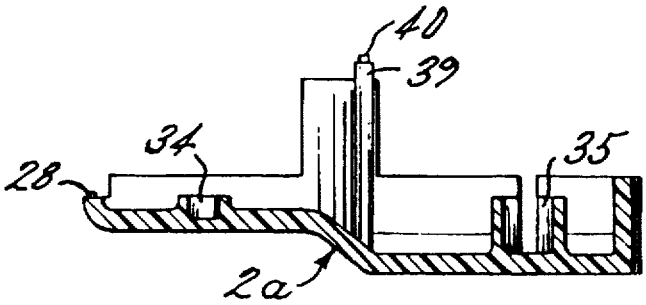
FIG. 18*d* is a cross-section taken along 18*d*—18*d;*
Figure 19A:
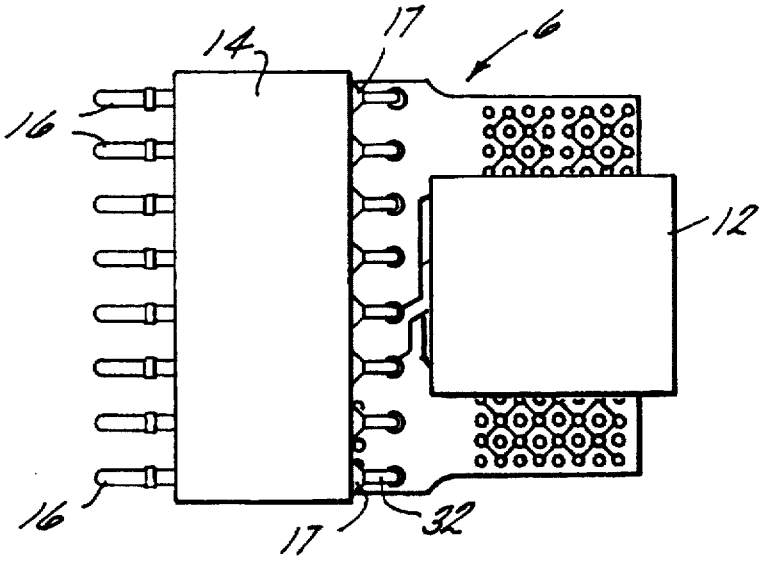
FIG. 19*a* is a plan view of the subassembly of the invention.
Figure 19B:
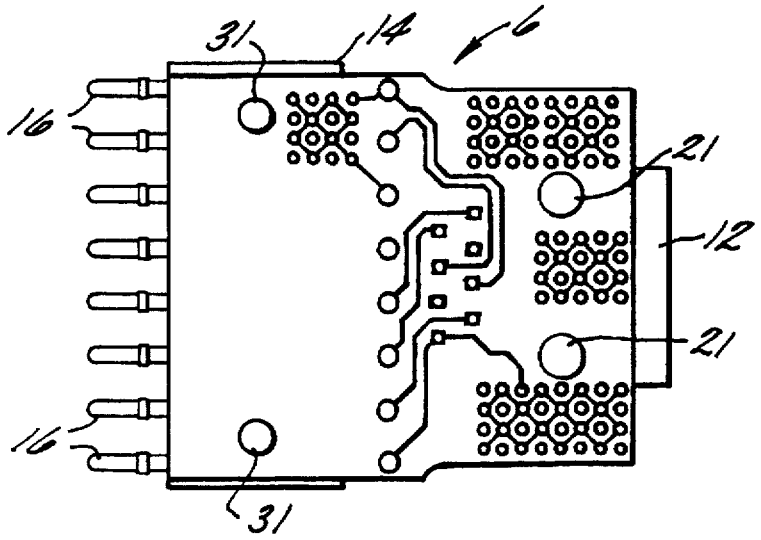
FIG. 19*b* is an underside view of 19*a*.

As aforesaid, the basic concept of the invention is useable for 1 pair, 2 pair, 3 pair or 4 pair of terminations in a 110 connector. As will be easily appreciable to one of skill in the art, the housing 1 is slightly different in each case. The number of contacts 16 obviously changes; this can either be accomplished by leaving empty passages 20 in a housing having the capacity for more contacts 16, or alternatively the housing itself can be made to accept only the number of contacts 16 desired. For example, in the case of a 1 pair housing the front end of the housing 1 is markedly less wide than the 4 pair model. Moreover, as shown in FIGS. 18*a* and 18*b*, cover 4*a* is different in cross-section from cover 4. This embodiment includes support wall 38 to abut modular jack 12. Therefore, it can be understood that cover 4*a* does not extend around modular jack 12. Base 2*a* is illustrated in FIG. 18*d* recess 34 and socket 35 are similarly placed as in FIG. 1*b*. Base 2*a* also includes post 39 which has nub 40 thereon to engage holes 41 in cover 4*a* shown in FIG. 18*a*.

There is no fixed limit of how many contacts might be desirable or employable, however, in the preferred embodiment only 1, 2, 3 or 4 pair front ends are directly preferred.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications test adapter comprising:

(a) a housing defining an interior space;

(b) an electrical interconnector mounted within said interior space of said housing;

(c) a telecommunications connector electrically connected to said electrical interconnector and arranged within said housing so as to be accessible from an exterior of said housing; and (d) at least two longitudinally spring loaded contacts electrically connected to said electrical interconnector, said electrical interconnector providing an electrical interconnection between said telecommunications connector and said at least two longitudinally spring loaded contacts, said at least two longitudinally spring loaded contacts extending from within said interior space of said housing to said exterior of said housing, said at least two longitudinally spring loaded contacts providing resilient electrical connection with electrical contacts of a separate telecommunications structure.

2. A telecommunications test adapter as claimed in claim 1 wherein said connector is a modular jack.

3. A telecommunications test adapter as claimed in claim 1 wherein said interconnector means is a printed circuit board.

4. A telecommunications test adapter as claimed in claim 3 wherein said circuit board includes a plurality of plated through holes to provide capacitance to minimize cross-talk.

5. A telecommunications test adapter as claimed in claim 1 wherein said adapter includes a support structure for receiving said at least two longitudinally spring loaded contacts.

6. A telecommunications test adapter as claimed in claim 5 wherein said support includes conductive sleeves, electrically connected to said interconnector.

7. A telecommunications test adapter as claimed in claim 6 wherein each of said at least two longitudinally spring loaded contacts are maintained in position and are electrically connected to said interconnector by individual ones of said sleeves.

8. A telecommunications test adapter as claimed in claim 7 wherein each of said at least two longitudinally spring loaded contacts are frictionally connected to individual ones of said sleeves.

9. A telecommunications test adapter as claimed in claim 1 wherein said adapter is configured to provide category five compliance.

10. A telecommunications test adapter comprising:

(a) a housing defining an interior space;

(b) a printed circuit board mounted within said interior space of said housing;

(c) a modular jack electrically connected to said printed circuit board and arranged within said housing so as to be accessible from an exterior of said housing; and (d) at least two longitudinally spring loaded contacts electrically connected to said printed circuit board, said printed circuit board providing an electrical interconnection between said modular jack and said at least two longitudinally spring loaded contacts, said at least two longitudinally spring loaded contacts extending from within said interior space to said exterior of said housing, said at least two longitudinally spring loaded contacts providing resilient electrical connection with electrical contacts of a separate telecommunications structure.

* * * * *